US010598442B2

(12) United States Patent
Liu et al.

(10) Patent No.: US 10,598,442 B2
(45) Date of Patent: Mar. 24, 2020

(54) FLAT HEAT PIPE STRUCTURE

(75) Inventors: Leilei Liu, Hui Zhou (CN); Xuemei Wang, Guang Dong (CN)

(73) Assignee: Cooler Master Development Corporation, New Taipei (TW)

( * ) Notice: Subject to any disclaimer, the term of this patent is extended or adjusted under 35 U.S.C. 154(b) by 468 days.

(21) Appl. No.: 13/417,898

(22) Filed: Mar. 12, 2012

(65) Prior Publication Data

US 2013/0233518 A1 Sep. 12, 2013

(51) Int. Cl.
*F28D 15/04* (2006.01)
*F28D 15/02* (2006.01)

(52) U.S. Cl.
CPC ..... *F28D 15/04* (2013.01); *F28D 15/0233* (2013.01); *F28D 15/046* (2013.01); *F28F 2225/04* (2013.01)

(58) Field of Classification Search
CPC ..... F28D 26/0233; F28D 26/046; F28D 15/0233; F28D 15/046; F28D 15/0266; H01L 23/427
USPC ..... 165/104.26, 104.33
See application file for complete search history.

(56) References Cited

U.S. PATENT DOCUMENTS 4,118,756 A * 10/1978 Nelson ..... F28D 15/0233 165/104.26
4,770,238 A * 9/1988 Owen ..... F28D 15/0233 122/366
5,465,782 A * 11/1995 Sun ..... F28D 15/0233 165/104.26
6,745,825 B1 * 6/2004 Nakamura et al. ..... 165/104.26
7,275,588 B2 * 10/2007 Hsu ..... 165/104.26
7,278,469 B2 * 10/2007 Sasaki ..... F28D 15/0241 165/104.26
7,845,394 B2 * 12/2010 Chang ..... F28D 15/046 165/104.21
2010/0051239 A1 * 3/2010 Lin et al. ..... 165/104.26
2011/0030921 A1 * 2/2011 Zhang ..... F28D 15/046 165/104.21
2011/0088877 A1 * 4/2011 Oniki ..... F28D 15/046 165/104.26
2011/0174464 A1 * 7/2011 Liu et al. ..... 165/104.26
2012/0111541 A1 * 5/2012 Yan et al. ..... 165/104.26
2012/0305222 A1 * 12/2012 Yang et al. ..... 165/104.26
2013/0037242 A1 * 2/2013 Chen et al. ..... 165/104.26

FOREIGN PATENT DOCUMENTS

TW 577538 2/2004
TW 092205365 2/2004

* cited by examiner

*Primary Examiner* — Christopher R Zerphey
*Assistant Examiner* — For K Ling
(74) *Attorney, Agent, or Firm* — McDermott Will & Emery LLP

(57) ABSTRACT

The instant disclosure relates to a flat heat pipe structure, which includes a flat tubing and a support member. The flat tubing has two opposed main walls and two opposed connecting walls connected thereto. The main and connecting walls cooperatively define an internal space. The inner surfaces of the flat tubing are covered with a capillary structure. The support member is disposed in the internal space of the flat tubing and has at least one support arm. The support arm extends in the longitudinal direction of the flat tubing. The support arm has two opposed surfaces abutting to the capillary structure of the main walls.

10 Claims, 4 Drawing Sheets

FLAT HEAT PIPE STRUCTURE

BACKGROUND OF THE INVENTION

Field of the Invention

The instant disclosure relates to a flat heat pipe structure; more particularly, to a heat-moving flat heat pipe structure having internal support member.

Descriptions of Related Art

As the speed of a central processing unit (CPU) increases, more heat is given off by the CPU. The conventional heat dissipating device comprised of an aluminum heat sink and a fan can no longer accommodate the operational demand of today's CPU with increased clock speed. To address this issue, more powerful and capable heat pipes and vapor chambers have been developed to work with the heat sink.

Due to adhesive characteristic of the porous capillary structure of the heat pipe and pressure differential across its walls, a support member is required to be disposed in the heat pipe, such that the tubing has enough supporting strength after being flattened. However, the conventional support member typically is very rigid and makes the tubing very difficult to bend. According to an issued Taiwan Patent (Patent #577538), a support member having saw tooth-shaped ridges is disclosed. One of the concerns is the capillary structure or the tubing may be worn and/or damaged by these saw tooth-shaped ridges. Some of other existing support members have complex structural features. When these types of support members are disposed in heat pipes, the flow of the working fluid is rerouted from its normal path, which would adversely affect the heat dissipation efficiency.

To address the above issues, the inventors strive via industrial experience and academic research to present the instant disclosure, which can effectively improve the limitations described above.

SUMMARY OF THE INVENTION

The instant disclosure provides a flat heat pipe structure having a bendable support member. The support member can prevent the walls of the heat pipe from deforming inwardly and crimping at the bending portions. Thus, the heat pipe is better suited for bending.

Moreover, the instant disclosure provides a flat heat pipe structure having longitudinal passageways, where the path travelled by the working fluid is shortened.

To achieve the aforementioned objects, the heat pipe structure of the instant disclosure comprises a flat tubing and a support member. The flat tubing has two opposed flat main walls and two opposed connecting walls. The main walls are connected by the connecting walls in forming an internal space. A capillary structure is formed on the inner surfaces of the flat tubing. The support member has at least one elongated support arm disposed inside the internal space and extends longitudinally therein. Every support arm has two opposed flat surfaces abutting the capillary structure on the main walls.

Both sides of the support member are spaced apart from the connecting walls by a predetermined distance in the longitudinal direction of the heat pipe. The space created between each side of the support member and the corresponding connecting wall defines a longitudinal passageway for flowing the working fluid.

For advantages, the main walls of the flat heat pipe structure provide additional strength for the annular tubing during the flattening process. After disposing the support member inside the heat pipe structure, the heat pipe structure can be bent without crimping. Moreover, the heat pipe structure and the support member cooperatively form internal passageways for circulating the working fluid. The longitudinal passageways provide a shorter path for the working fluid to travel.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

BRIEF DESCRIPTIONS OF THE DRAWINGS

DETAILED DESCRIPTIONS OF THE EMBODIMENTS

To attain further understanding of the objectives, structural features, and functions of the instant disclosure, please refer to the detailed descriptions provided hereinbelow.

Figure 1:
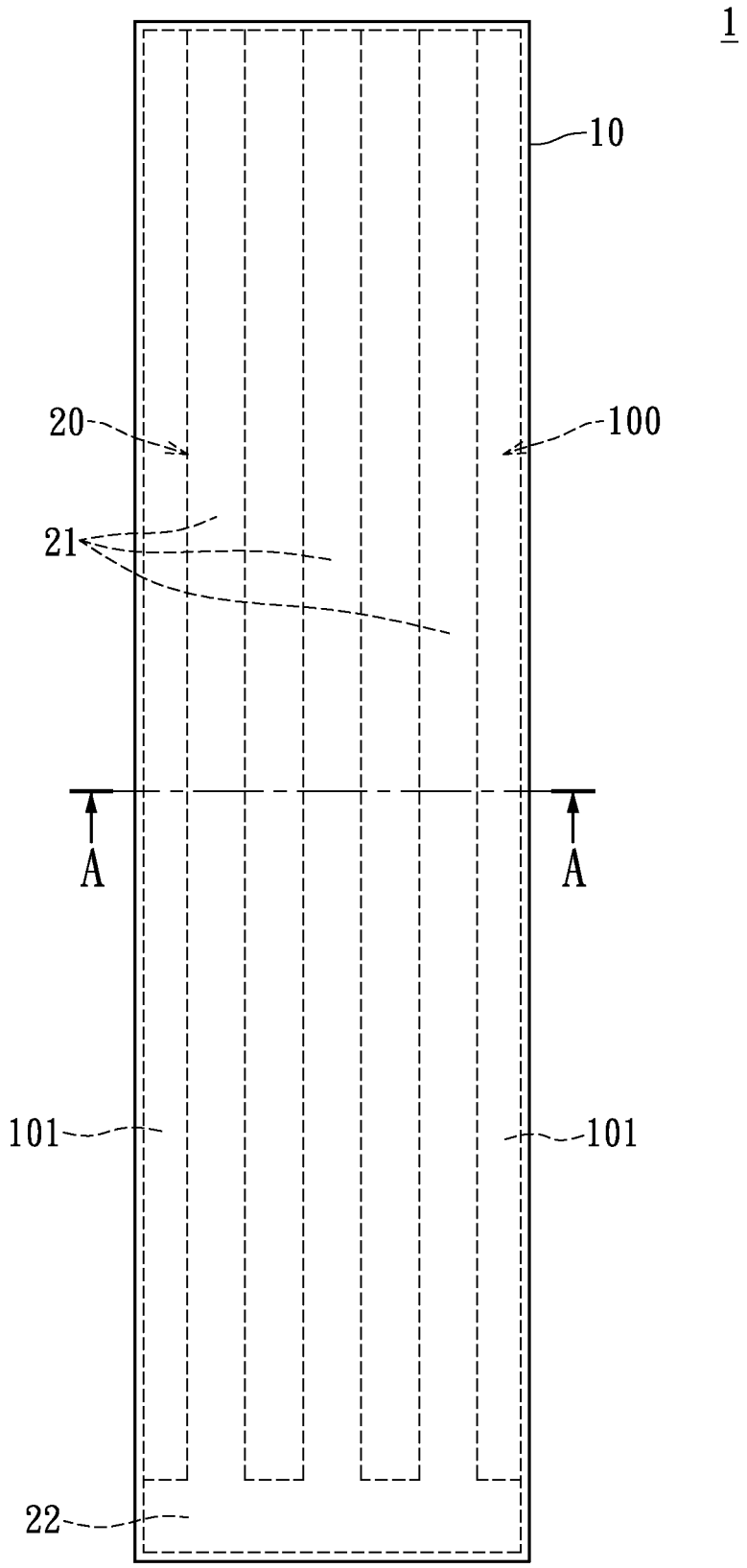
FIG. 1 is a top view of a flat heat pipe structure of the instant disclosure.
Figure 1A:
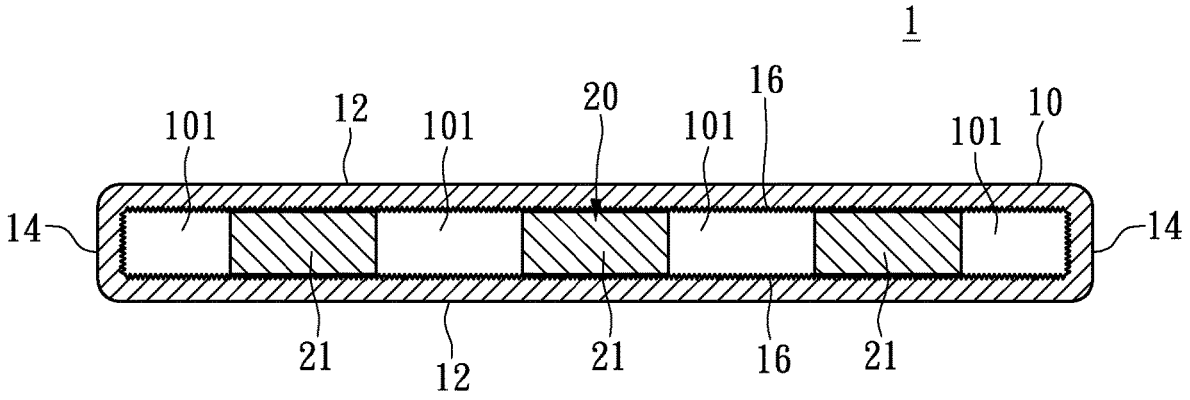
FIG. 1A is a cross-sectional view of the flat heat pipe structure in FIG. 1 taken along line AA.

FIG. 1 shows a top view of a flat heat pipe structure 1 of the instant disclosure, and FIG. 1A shows a cross-sectional view thereof taken along line AA in FIG. 1. The flat heat pipe structure 1 comprises a flat tubing 10 and a support member 20 disposed therein. The flat tubing 10 is made with material with excellent thermal conductivity and malleability such as aluminum, aluminum alloy, copper, copper alloy, etc. The flat tubing 10 is manufactured by flattening an annular tubing. For the instant embodiment, the flat tubing 10 is elongated and has a strip-like shape. Alternatively, the flat tubing 10 may be rectangular with a plate-like shape, where the exact structural shape of the flat tubing 10 is not restricted.

The flat tubing 10 is defined by two opposed main walls 12 and two opposed connecting walls 14. The connecting walls 14 are connected between the main walls 12 and cooperatively form an internal space 100. The opposite ends of the flat tubing 10 are welded closed to seal the flat tubing 10. A capillary structure 16 is formed on the inner surfaces of the flat tubing 10. Namely, the capillary structure 16 covers the inner surfaces of the main and connecting walls 12 and 14 for transporting the working fluid (not shown). The capillary structure 16 may be provided in various forms such as a metal mesh, grooves, or a sintered body of metal powder.

The support member 20 is preferably made of high temperature resistant and bendable material, such as copper. The support member 20 has at least one support arm 21 disposed in the internal space 100 of the flat tubing 10. For the instant embodiment, the support member 20 has three support arms 21 arranged in parallel to each other. Each support arm 21 extends along the longitudinal direction or the long axis of the flat tubing 10. At least one support arm 21 has two opposed flat surfaces, namely, a top surface and a bottom surface, for the orientation shown in FIG. 1A. The top and bottom surfaces abut the capillary structure 16 of the main walls 12. The support arms 21 serve as structural supports for the flat tubing 10. Moreover, the support arms 21 and the flat tubing 10 cooperatively form a plurality of passageways 101, where the passageways 101 are arranged in parallel to each other and extend longitudinally along the flat tubing 10.

The opposite sides of the support member 20 extending in the longitudinal direction of the flat tubing 10 are spaced apart from the connecting walls 14 by a predetermined distance. In other words, the support arms 21 do not touch the connecting walls 14. The spaces formed between the support arms 21 and the connecting walls 14 along the longitudinal direction of the flat tubing 10 serve as internal passageways 101. The passageways 101 are in communication with both ends of the flat heat pipe structure 1. One end of the flat heat pipe structure 1 being the evaporator section for absorbing heat, and the other end being the condenser section for giving up latent heat of vaporization. At the condenser section, the working fluid changes from a vapor state to a liquid state. These longitudinal passageways 101 provide the shortest distance that the working fluid has to travel between opposite ends of the flat heat pipe structure 1, thus greatly raising the heat dissipation efficiency. It is worth noting the support arms 21 of the support member 20 may also be arranged touchingly to the respective connecting walls 14, for preventing the connecting walls 14 from deforming inwardly and crimping after bending.

Figure 2:
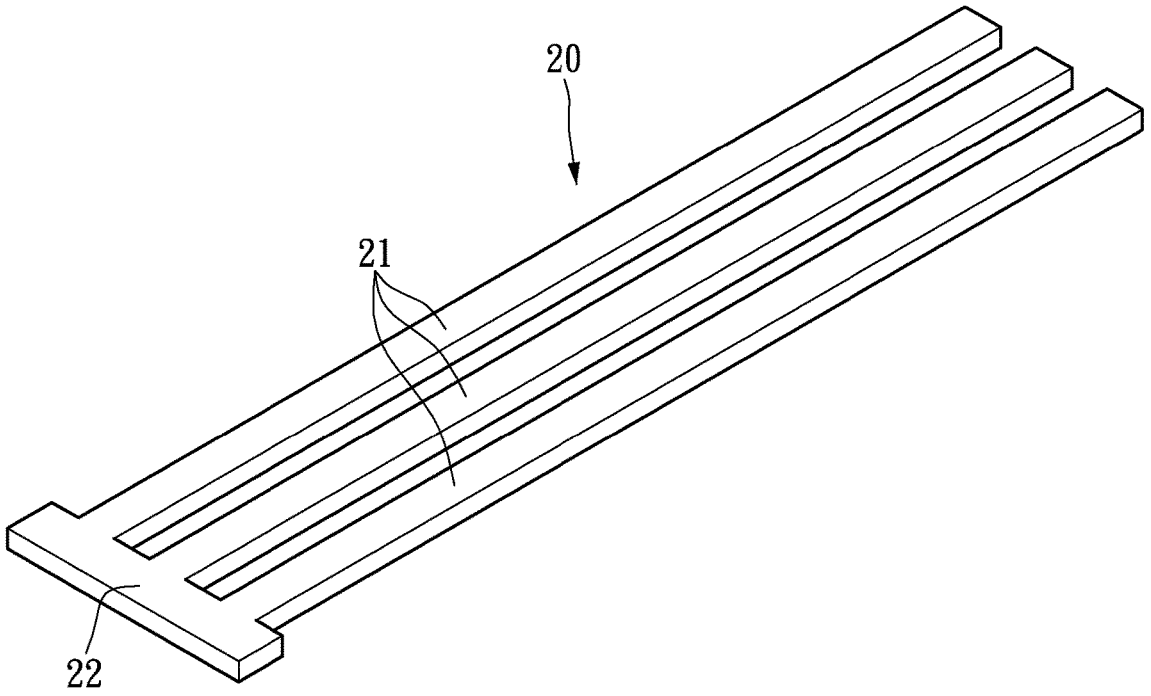
FIG. 2 is a perspective view of a support member for the flat heat pipe structure of the instant disclosure.

Please refer to FIG. 2, which is a perspective view showing the support member 20 of the flat heat pipe structure 1. As described previously, the support member 20 of the instant embodiment has three support arms 21. The support arms 21 are parallelly spaced apart from one another, where the number of support arms 21 is not restricted. The support member 20 may have more than one support arm 21, where the support arms 21 are equally spaced from one another inside the flat tubing 10. The distance between adjacent support arms 21 depends on the dimension of the flat tubing 10 along the short axis of the flat tubing 10. The support member 20 further has a connecting portion 22 connecting to one end of each support arm 21. The width of the connecting portion 22 is substantially equal to or less than the width of the internal space 100 along the short axis of the flat tubing 10. Furthermore, the opposite ends of the connecting portion 22 do not have to extend normally beyond the support arms 21. The purpose of the connecting portion 22 is to maintain the support arms 21 spaced apart from each other. Especially after the support arms 21 have been disposed in the annular tubing, the connecting portion 22 prevents the misplacing of the support arms 21 during the flattening process. For the instant embodiment, the shape of the connecting portion 22 is rectangular but is not restricted thereto. For example, the connecting portion 22 may be a rod-shaped structure. Alternatively, the support member 20 may have two connecting portions 20. The second connecting portion 20 may be arranged on the other end of each support arm 21.

Figure 3:
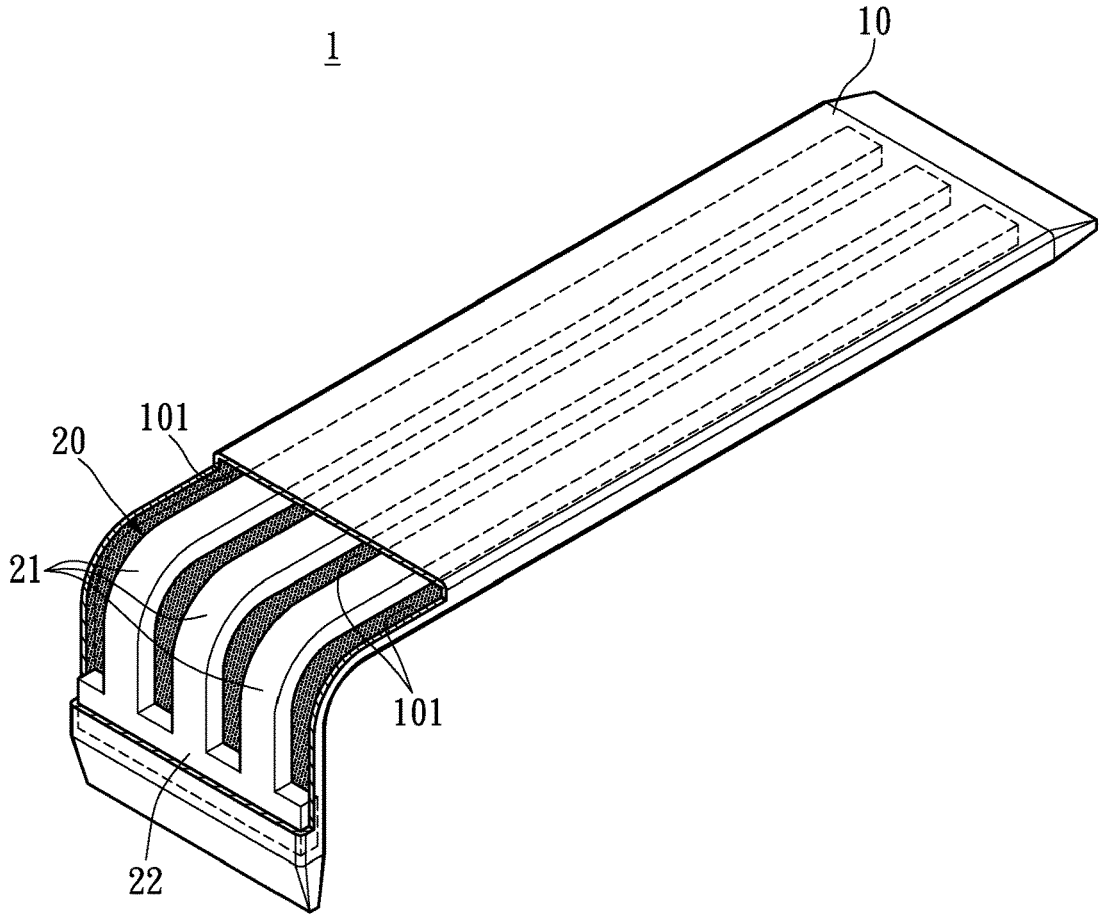
FIG. 3 is a perspective view of the flat heat pipe structure of the instant disclosure.

Please refer to FIG. 3, which is a perspective view of the flat heat pipe structure 1 of the instant disclosure. The connecting portion 22 is arranged proximate to one end of the flat tubing 10. During the flattening process of the annular tubing, the support member 20 provides structural support to the main walls 12, thus preventing the main walls 12 from deforming inwardly or crimping. Whereas during the bending process of the flat tubing 10, the support member 20 also allows the main walls 12 to maintain smooth surfaces. The other advantage of the instant disclosure is the formation of longitudinal passageways 101. The passageways 101 provide a shorter path for the working fluid to travel between the ends of the flat tubing 10.

Figure 4:
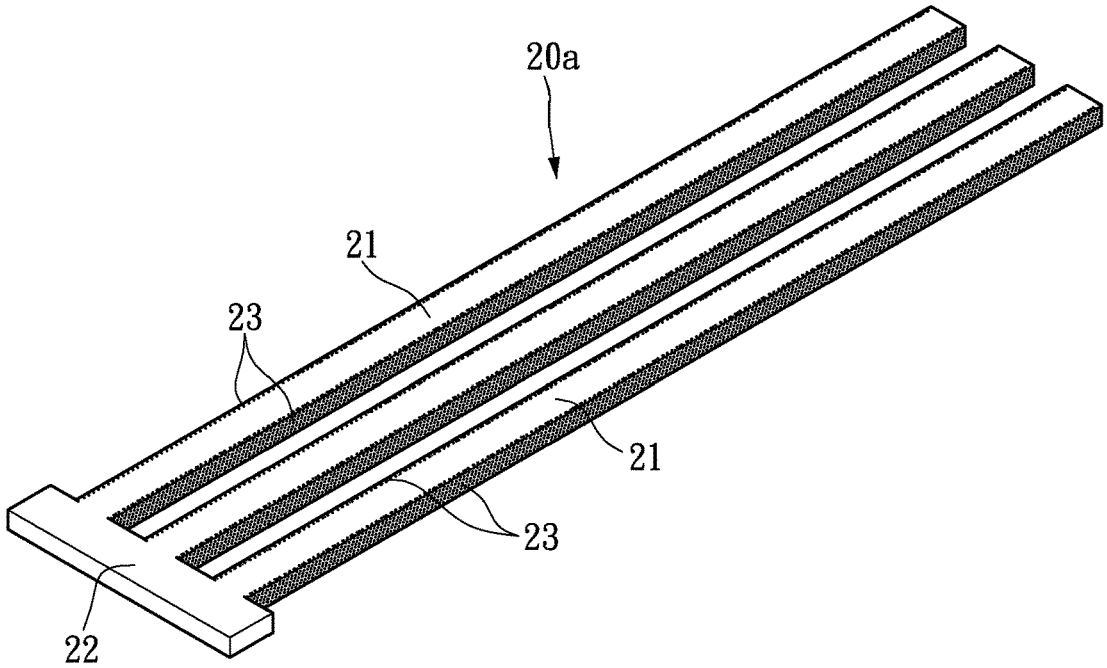
FIG. 4 is a perspective view of a support member for a second embodiment of the instant disclosure.

Please refer to FIG. 4, which is a perspective view showing an alternate support member 20*a*. For the support member 20*a*, a second capillary structure 23 is formed on the opposed side surfaces of each support arm 21. Similarly, the capillary structure 23 may be provided in various forms such as a metal mesh, grooves, a sintered body of metal powder, or a composite capillary structure.

Figure 5:
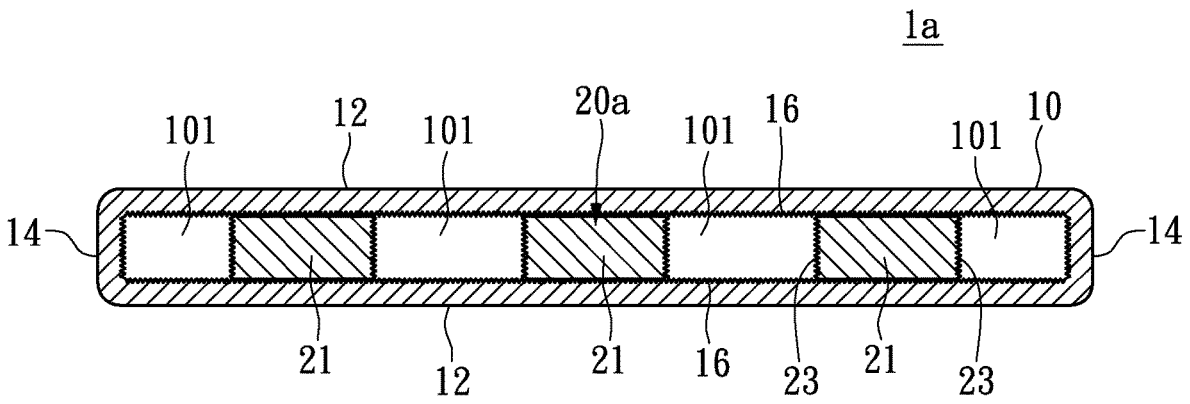
FIG. 5 is a cross-sectional view of a flat heat pipe structure of the instant disclosure having the support member shown in FIG. 4.

Please refer to FIG. 5, which is a cross-sectional view of the support member 20*a* shown in FIG. 4 and a flat heat pipe structure 1*a*. Based on the aforementioned structural features of the support member 20*a*, the capillary structures 16 and 23 cooperatively surround the passageways 101. In other words, the inners walls that define each passageway 101 are covered with capillary structures. The addition of the second capillary structure 23 further enhances the heat dissipation efficiency of the heat pipe structure 1*a*.

Figure 6:
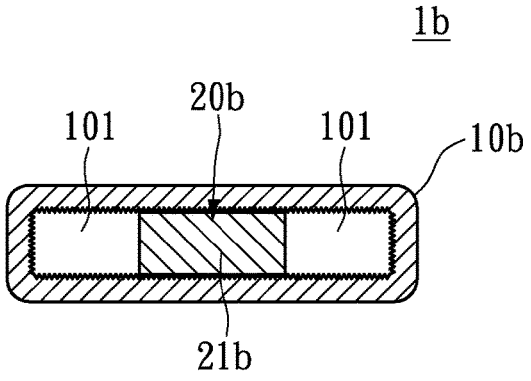
FIG. 6 is a cross-sectional view of a flat heat pipe structure for a third embodiment of the instant disclosure.

Please refer to FIG. 6, which is a cross-sectional view showing a heat pipe structure 1*b* for a third embodiment of the instant disclosure. The instant embodiment is particularly suitable in cases where a heat pipe is required to be bent. The width or the lateral dimension of the heat pipe structure 1*b* is not restricted. When the internal space 100 within the heat pipe structure 1*b* is more limited, the heat pipe structure 1*b* may include only one support arm 21*b*, as illustrated in FIG. 6. Moreover, the single support arm 21*b* and a flat tubing 10*b* cooperatively form two longitudinal passageways 101.

Based on the foregoing descriptions, the main walls 12 provide additional strength for the annular tubing during the flattening process. The instant disclosure is especially suitable in cases where a heat pipe is required to be bent. A smooth surface can be maintained at the bent portion of the flat heat pipe structure without crimping. Especially for large sized flat heat pipe structure, a smooth surface can be maintained across the main walls 12. Moreover, after the support member has been disposed in the flat heat pipe structure, the heat pipe structure can still be bent as needed. In addition, the formation of longitudinal passageways provides a short path for transporting the working fluid.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. A flat heat pipe structure, comprising:

a flat tubing having two opposed main walls and two connecting walls connected thereto, wherein the main walls and the connecting walls cooperatively define an internal space, wherein a first capillary structure is disposed on inner surfaces of the flat tubing; and a support member disposed in the internal space and having at least two support arms, wherein each support arm extends along a longitudinal direction of the flat tubing, each support arm has a first surface and a second surface opposite the first surface, the first surface and the second surface contact the first capillary structure, each support arm includes a first end and a second end longitudinally opposite the first end, the first ends of each support arm are connected to each other by a connecting portion and the second ends of each support arm are free of any contact with each other, and the first surface and the second surface each extends continuously from the first end to second end.

2. The flat heat pipe structure of claim 1, wherein the support member is spaced apart from the connecting walls by a predetermined distance, and wherein a longitudinal passageway is formed between the support member and an adjacent connecting wall.

3. The flat heat pipe structure of claim 1, wherein the support member includes a plurality of support arms, the plurality of support arms including the at least two support arms, the plurality of support arms are spaced apart from one another, and a plurality of longitudinal passageways are formed between the plurality of supports arms and the flat tubing.

4. The flat heat pipe structure of claim 3, wherein the outermost support arms of the support member are arranged proximate to the corresponding connecting walls.

5. The flat heat pipe structure of claim 3, wherein the support arms are arranged in parallel inside the flat tubing.

6. The flat heat pipe structure of claim 1, wherein a width of the connecting portion is equal to or less than a width of the internal space along a short axis of the flat tubing.

7. The flat heat pipe structure of claim 1, wherein the connecting portion is rectangular or rod-like shaped.

8. The flat heat pipe structure of claim 1, wherein the connecting portion is arranged proximate to one end of the flat tubing.

9. The flat heat pipe structure of claim 3, wherein opposite side surfaces of each support arm are covered with a second capillary structure, and wherein the second capillary structure and the first capillary structure are arranged in the passageways.

10. The flat heat pipe structure of claim 3, wherein each support arm of the plurality of support arms includes a first end and a second end, the second end being longitudinally opposite the first end, and the first ends of each support arm of the plurality of support arms are connected to each other by the connecting portion and the second ends of each support arm of the plurality of support arms are free of any contact with each other.

* * * * *